US006668852B1

(12) United States Patent
Williamson

(10) Patent No.: US 6,668,852 B1
(45) Date of Patent: Dec. 30, 2003

(54) FROST PROOF SILLCOCK SERVICE SLEEVE

(75) Inventor: John Theodore Williamson, Philpot, KY (US)

(73) Assignee: Continental Industries, Inc., Owensboro, KY (US)

( * ) Notice: Subject to any disclaimer, the term of this patent is extended or adjusted under 35 U.S.C. 154(b) by 0 days.

(21) Appl. No.: 10/316,150

(22) Filed: Dec. 11, 2002

(51) Int. Cl.[7] ..... E03B 9/14; E03B 7/12

(52) U.S. Cl. ..... 137/312; 137/15.17; 137/15.18; 137/301; 137/360; 137/375

(58) Field of Search ..... 137/301, 302, 137/312, 239, 360, 369, 370, 375, 15.17, 15.18, 801

(56) References Cited

U.S. PATENT DOCUMENTS 3,407,837 A * 10/1968 Fulton et al. ..... 137/375
3,797,518 A * 3/1974 Holm ..... 137/442
4,158,366 A * 6/1979 Van Meter ..... 137/312
4,182,364 A * 1/1980 Gilbert et al. ..... 137/426
4,314,580 A * 2/1982 Steinwand ..... 137/360
4,473,244 A * 9/1984 Hill ..... 137/360
4,538,637 A * 9/1985 Williams ..... 137/360
4,836,237 A * 6/1989 McCullough ..... 137/312
5,035,257 A * 7/1991 Antunez ..... 137/426
5,632,303 A * 5/1997 Almasy et al. ..... 137/360
5,697,393 A * 12/1997 Mirlisena, Sr. ..... 137/360
5,842,499 A * 12/1998 Hall ..... 137/360
6,394,125 B2 * 5/2002 White ..... 137/312

* cited by examiner

*Primary Examiner*—George L. Walton
(74) *Attorney, Agent, or Firm*—Gary K. Price, Esq.

(57) ABSTRACT

A service sleeve coupled with a frost proof sillcock including a housing having an outer surface and defining an inner chamber for receiving an inner portion of the sillcock, a stem portion, and an area of water pipe that extends radially from the stem portion to the structure's water supply. The service sleeve further includes a cap having an inner surface, a first end having a diameter to receive the outer surface of the housing, and a second end having a diameter sized to slidingly receive the water pipe. The stem portion having a male portion and a female portion. The male and female portions have bores therethrough. The female portion having an inlet end coupled to the water pipe and an opening opposite the inlet end for access to the bore of the female portion. The male portion having an outlet end for connecting to the inner portion of the sillcock and an opening for access to the bore of the male portion. The male portion further including an extension portion having two circular grooves formed of the width of the extension portion to receive sealing rings. The extension portion of the male portion configured to slide in and out the bore through the opening of the female portion, and therefore, the male portion and female portion will generally be telescopically engaged.

13 Claims, 3 Drawing Sheets

FROST PROOF SILLCOCK SERVICE SLEEVE

CROSS REFERENCES TO RELATED APPLICATIONS

None.

Statement as to Rights to Inventions Made Under Federally Sponsored Research and Development Not Applicable

BACKGROUND OF THE INVENTION

1. Field of the Invention

The present invention relates generally to water valves known as sillcocks, and more particular, to a service sleeve coupled with a frost proof sillcock for preventing resulting water damage to a wall of a structure should the sillcock rupture or crack.

2. Brief Description of Prior Art

Water faucet assemblies are traditionally installed within building structures, such as to deliver water outside of the structure. A conventional sillcock includes a pipe structure that extends through the structure wall. The pipe structure includes a body portion having a water faucet or spout, which is positioned at an outside wall surface, and an inner portion that is positioned at an inner surface of the wall and is connected to the structure's water supply. The sillcock also includes a valve operated by a handle. When the valve is turned to an on position, the valve is unseated and water is allowed to flow through the water spout. Conversely, when the valve is seated in the off position, the flow of water is prevented.

Traditionally, in freezing temperatures, a sillcock having its valve disposed outside the structure has a tendency to rupture or crack as water retained by the valve expands in response to freezing conditions. As a result, frost proof sillcocks are available in which the valve is disposed inside the structure so it will stay warm, while maintaining the handle and spout outside the structure. The valve being disposed within the interior of the structure, is not exposed to freezing temperatures and therefor less likely to rupture or break. However, frost proof sillcocks will still rupture when for example, a hose is connected to the sillcock thereby preventing the sillcock from fully draining when the valve is turned to the off position. As a result, water held in the sillcock will freeze and expand in cold weather causing the sillcock to rupture and crack. Subsequent use of the sillcock after thawing will result in water flowing through said cracks causing water damage to the interior structure.

A variety of sillcocks having freeze resistant characteristics have been proposed heretofore. Protective devices have been developed with the objective of directing leaking water from the cracked sillcock to outside the structure, rather than causing damage to the interior of the structure. These protective devices that are made to retrofit an existing structure have proven to be difficult to install with conventional sillcocks, since installation generally requires the finished wall or ceiling to be cut or damaged in order to access the pipe structure connected to the sillcock.

Also, existing protective devices are developed for particular brands, size or length of sillcocks. Traditionally, frost proof sillcocks are manufactured in a variety of fixed lengths. However, these fixed lengths vary slightly from manufacturer to manufacturer. The length of the sillcock assembly is determined by the width of the wall surface in which the sillcock is to be installed. As may be appreciated, an installer may be faced with installation in a number of different structures, each having different wall thickness. The prior art protective devices are not capable of adapting to various brands of sillcocks or varying lengths.

As will be seen from the subsequent description, the preferred embodiments of the present invention overcome shortcomings of the prior art.

SUMMARY OF THE INVENTION

The present invention relates generally to a service sleeve coupled with a frost proof sillcock for preventing damage to a wall of a structure caused by a ruptured sillcock. Specifically, the present invention is designed to direct leaking water from the ruptured sillcock to outside the structure.

The frost proof sillcock service sleeve of the present invention coupled with a conventional frost proof sillcock, which sillcock generally includes a body portion proximate the outside surface of the wall of a structure, an inner portion proximate the inside surface of the wall, a water spout and a valve handle. Said sillcock secured against the outside wall with a flange or collar.

The service sleeve of the present invention includes an elongated cylindrical housing having an outermost end, an inner end, and an outer surface defining an inner chamber, said inner chamber for receiving the inner portion of the sillcock, a stem portion of the present invention, and for receiving an area of a water pipe that extends radially from the stem. Attached to the outermost end of the housing is said flange or collar that extends radially from the outermost end. Said collar includes at least two screw holes to receive screws for securing to the outside of the wall of the structure. The collar further including a central opening for receiving the outer surface of the outermost end of the housing.

The stem portion defined by a male portion and a female portion. The male and female portions have bores therethrough. The female portion having an inlet end coupled to the water pipe, and an opening opposite the inlet end, said opening for access to the bore of the female portion. The male portion having an outlet end for connected to the inner portion of the sillcock, and an opening opposite the outlet end, said opening for access to the bore of the male portion. The male portion further including an extension portion, said extension portion having two circular grooves formed the width of the extension portion to receive sealing rings, such as O-rings. The extension portion of the male portion configured to slide in and out the bore through the opening of the female portion.

The frost proof sillcock service sleeve further includes a cap having an inner surface, a first end having a diameter to receive the outer surface of the housing, and a second end having a diameter sized to slidingly receive the water pipe. As such, the housing is snugly received in the first end of the cap, and the cap is slidingly positioned along the outer surface of the water pipe.

In the event water held in the stem of the sillcock freezes and expands in response to freezing temperatures, causing the sillcock to rupture and crack, subsequent use of the sillcock once the frozen water in the sillcock is allowed to thaw, will result in water flowing through said cracks in the sillcock causing water damage to the interior structure. In accordance with the principles of the present invention, the frost proof sillcock service sleeve will prevent damage to the interior structure caused by a ruptured sillcock. Water leaking from the cracked sillcock will remain within the inner chamber of the housing and drain through the collar, and outside the structure.

DESCRIPTION OF THE PREFERRED EMBODIMENT

Figure 1:
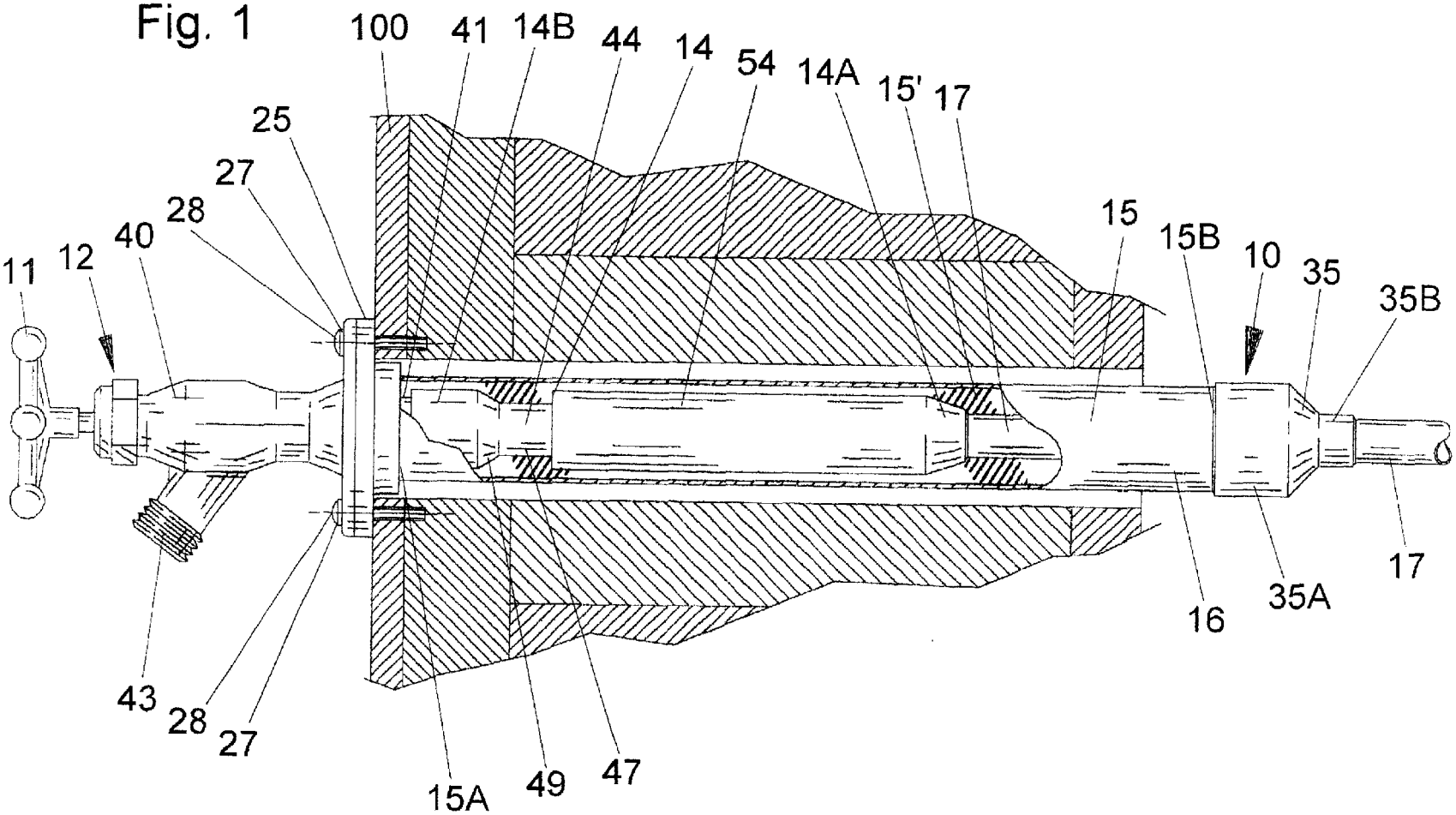
FIG. 1 is a side view of a preferred embodiment of the present invention, a frost proof sillcock service sleeve, wherein the sleeve coupled with a sillcock is attached to the outside wall of a structure.

FIGS. 1–4 illustrate a preferred embodiment of a frost proof sillcock service sleeve 10 made in accordance with the present invention. The frost proof sillcock service sleeve 10 for preventing damage to a wall of a structure caused by a ruptured sillcock. Specifically, it will be noted in the drawings that the apparatus relates to a service sleeve coupled with a traditional sillcock for preventing resulting water damage to a wall of a structure should the sillcock rupture or crack, by directing the leaking water from the ruptured sillcock to outside the structure. In the broadest context, the device consists of components configured and correlated with respect to each other so as to attain the desired objective.

Referring to FIG. 1, a conventional frost proof sillcock 12 generally includes a body portion 40 proximate the outside surface of a wall 100 of a structure, an inner portion 41 proximate the inside surface of the wall 100, a water spout 43, and a valve handle 47. The conventional sillcock 12 further including a threaded portion (not shown) formed with threads generally for coupling with the structure's water supply.

Accordingly, water flow through the sillcock 12 is controlled by the valve handle 47. When water flow is desired, the handle 47 is rotated in a counter clockwise direction thereby turning a conventional valve (not shown) within the sillcock 12 to unseat and water is allowed to flow through the body portion 40 and out the water spout 43 of the sillcock 12. Conversely, when it is desired to stop the flow of water, the valve handle 47 is rotated in a clockwise direction to seat the valve within the sillcock 12. Once seated, the water flow will stop and any water remaining within the sillcock 12 is permitted to drain through the spout 43. In the event the water does not drain once the valve is seated, for instance if a hose is connected to the spout 43, or should the valve disposed within the sillcock 12 fail, the water may freeze and expand in response to freezing temperatures, causing the sillcock 12 to rupture and crack. Subsequent use of the sillcock 12 once the frozen water in the sillcock 12 is allowed to thaw, will result in water flowing through said cracks. In accordance with the principles of the present invention, the frost proof sillcock service sleeve 10 of the present invention is designed to direct the leaking water from the ruptured sillcock 12 to outside the structure, in order to avoid water damage to the structure.

Figures 2, 3:
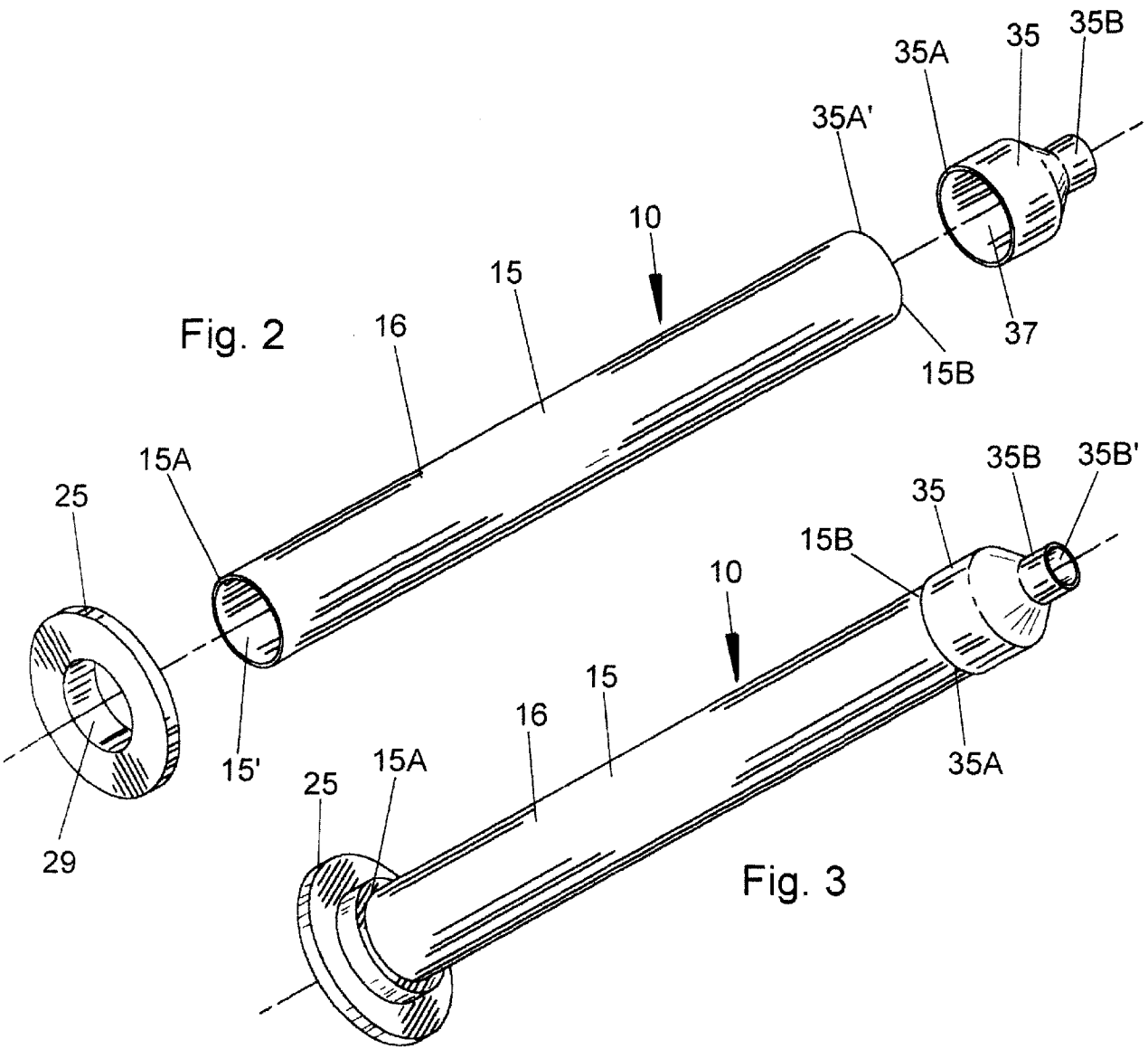
FIG. 2 is an exploded elevational perspective view of components of the frost proof sillcock service sleeve of FIG. 1, namely, a sleeve, a collar, and a cap.
FIG. 3 is an elevational perspective view of the service sleeve of FIG. 2.

Referring now to FIGS. 1–3, the frost proof sillcock service sleeve 10 includes an elongated cylindrical housing 15, said housing 15 including an outermost end 15A, an inner end 15B, and an outer surface 16 defining an inner chamber 15', said inner chamber 15' for receiving the inner portion 41 of the sillcock 12, a stem portion 14, and as will be further described, an area of a water pipe 17 of the structure's water supply.

Figure 4:
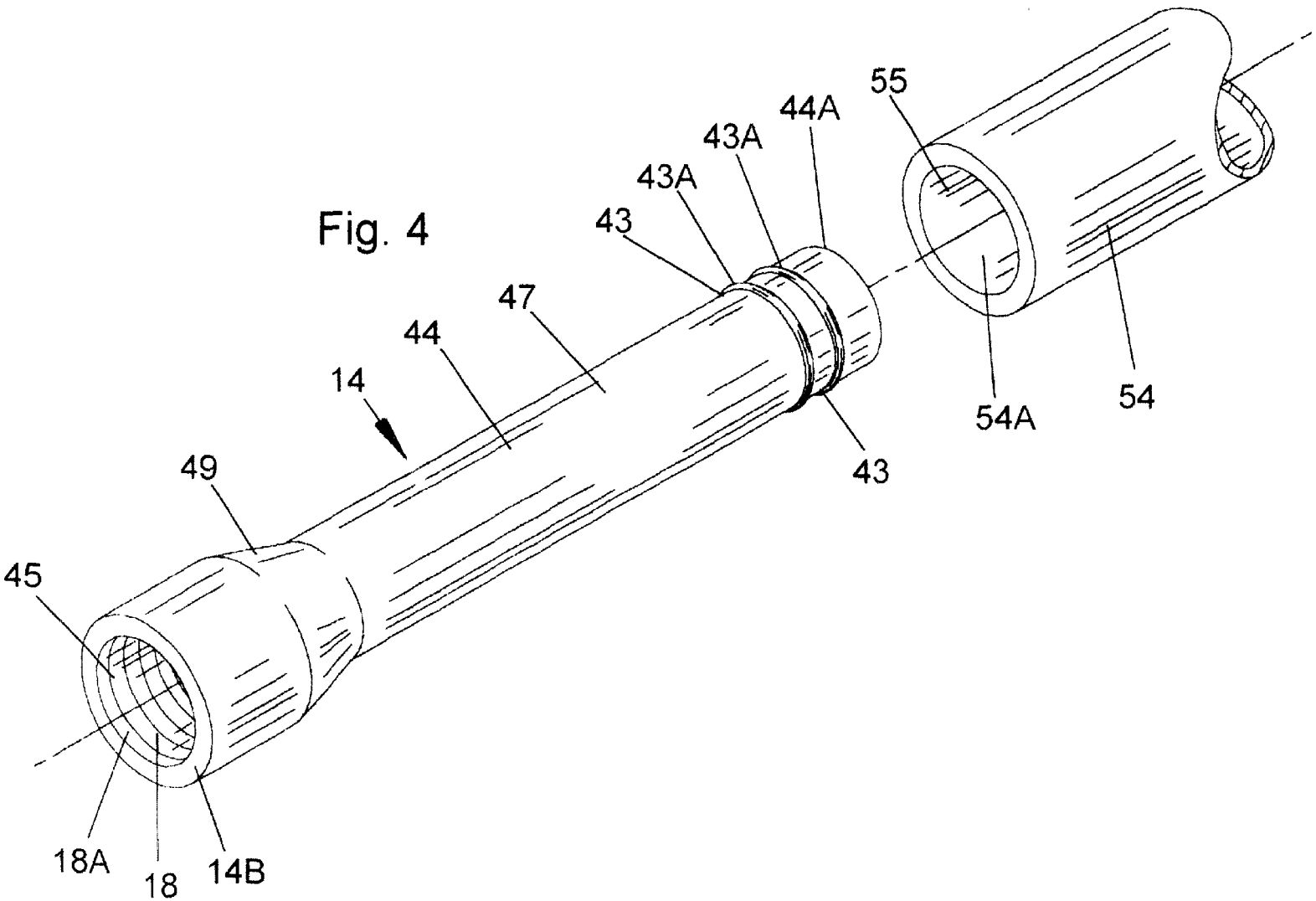
FIG. 4 is an exploded elevational perspective view of the components of a stem, namely, the male and female portions.

As best shown in FIG. 4, the stem portion 14 having a male portion 44 and a female portion 54. The male and female portions 44, 54 have bores 45 and 55 respectively, therethrough. The female portion 54 having an inlet end 14A that is coupled to the water pipe 17 by conventional means, such as sweat soldering, brazing, welding, or gluing. The water pipe 17 extends radially from the inlet end 14A of the female portion 54 of the stem 14. The female portion 54 having an opening 54A opposite the inlet end 14A, said opening 54A for access to the bore 55 of the female portion 54.

The male portion 44 having an outlet end 14B having a threaded portion 18 formed with threads 18A and appropriately connected to the inner portion 41 of the sillcock 12. The male portion 44 further including an opening 44A opposite the outlet end 14B, said opening 44A for access to the bore 45 of the male portion 44. The diameter of the outlet end 14B being greater than the diameter of the balance or remainder of the male portion 44 that defines a shoulder 49.

As shown in the drawings, disposed between the outlet end 14B and the opening 44A of the male portion 44 is an extension portion 47, said extension portion 47 extending from the opening 44A of the male portion 44 and terminates at the shoulder 49. Two circular grooves 43 are formed the width of the extension portion 47 to receive sealing rings 43A, such as an O-rings. The extension portion 47 of the male portion 44 is configured to slide in and out the bore 55 through the opening 54A of the larger diameter female portion 54, and therefore, the male portion 44 and female portion 54 will generally be telescopically engaged. Each of the sealing rings 43A that encircle the extension portion 47 form a water-tight seal between the male portion 44 and the female portion 54. As such, the inlet end 14A of the female portion 54 of the stem 14 is in fluid communication with the outlet end 14B of the male portion 44 of the stem 14 coupled to the inner end 41 of the sillcock 12, as water flows through the bores 55, 45 respectively.

Freeze proof sillcocks are traditionally manufactured in varying lengths. The length of the sillcock is determined by the width of the wall surface in which the sillcock is to be installed. As may be appreciated, an installer may be faced with installation in a number of different structures, each having different wall thickness. The service sleeve 10 of the present invention is capable of adapting to sillcocks of various lengths. Depending upon the length dimensions of the sillcock 12, the male and female portions 44, 54 may be adjusted in length, specifically the extension portion 47 of the male portion 44 is adjustably received within the bore 55 of the female portion 54 to adapt to the variety of different sillcock lengths. The stem portion 14 is telescopically adjusted as described above so that the combined length of the components situated in the inner chamber 15' of the housing 15, namely, the inner portion 41 of the sillcock 12, the stem 14 and that area of the water pipe 17 extending from the stem 14, generally matches the length of the housing 15. When the length of the sillcock varies, the stem portion 14 is also telescopically adjusted in length to maintain the said components within the housing 15. In application, the inner portion 41 of the sillcock 12, the stem portion 14, and the water pipe 17 extending from the inlet end 14A of the stem portion 14 are axially aligned with the housing 15.

As best shown in FIGS. 2 and 3, attached to the outermost end 15A of the housing 15 is a flange or collar 25 that extends radially from the outermost end 15A of the housing 15. Said collar 25 includes at least two screw holes 27 to receive screws 28 for securing the service sleeve 10 to the outside of the wall 100 of the structure. As shown in FIG. 2, the collar 25 further includes a central opening 29 having a diameter slightly greater than the diameter of the outer surface 16 of the housing 15 so that the outer surface 16 of the outermost end 15A of the housing 15 is fixedly received within the cental opening 29 of the collar 25 by conventional means, such as sweat soldering, brazing, welding, or gluing.

Said outermost end 15A of the housing 15 is connected to the collar 25 so that water in the inner chamber 15' of the housing 15 may drain through the collar 25 and outside the structure. The run of the water pipe 17, the stem 14, and the housing 15 of the present invention, slopes slightly downward to the sillcock 12 in order to facilitate draining of any water in the inner chamber 15' towards the collar 25 and outside the structure.

The frost proof sillcock service sleeve 10 further includes a cap 35, said cap 35 having an inner surface 37, and further including a first end 35A having an opening 35A', said first end 35A having a diameter to receive the outer surface 16 of the housing 15, and a second end 35B having an opening 35B', said second end 35B having a smaller diameter than the first end 35A, said second end 35B having a diameter sized to slidingly receive the water pipe 17. As shown in the drawings, the first end 35A of the cap 35 receives the outer surface 16 of the inner end 15B of the housing 15. As said first end 35A having a diameter slightly larger than the diameter of the housing 15, the outer surface 16 of the housing 15 is snugly received within the first end 35A forming a tight connection between the outer surface 16 of the housing 15 and the inner surface 37 of the first end 35A of the cap 35.

Likewise, as shown in FIG. 1, the second end 35B having a diameter slightly larger than the diameter of the water pipe 17 so that the cap 35 may be slidingly positioned along the outer surface of the water pipe 17. In use, the cap 35 maintains its selected position along the water pipe 17 because the inner surface 37 of the first end 35A is in frictional contact with the outer surface 16 of the housing 15 and, because the inner surface 37 of the second end 37B is in frictional contact with the outer surface of the water pipe 17. As will be further described, the water pipe 17 extends through the opening 35B' of the second end 35B of the cap 35, through the cap 35 and is attached to the inlet end 14A of the stem 14 within the housing 15.

The service sleeve 10 is simple to install and requires no physical modification to the sillcock 12 or water pipe 17. First, with the collar 25 and the body portion 40 of the sillcock 12 against the outer surface the wall 100, the length of the stem 14 is telescopically adjusted until the combined length of the inner portion 41 of the sillcock 12, the stem 14, and that area of the water pipe 17 extending from the stem 14 approximately matches the length of the housing 15. The cap 35 is positioned on the water pipe 17 by directing the end of the water pipe 17 through the opening 35B' of the second end 35B of the cap 35 so that the first end 35A of the cap 35 confronts the wall 100 of the structure. The stem 14 is disposed within the housing 15 and the water pipe 17 is attached to the inlet end 14A of the stem 14 within the housing 15 as described above. The housing 15 is then positioned first by inserting the outer surface 16 of the housing 15 within the first end 35A of the cap 35 forming a tight connection between the outer surface 16 of the housing 15 and the inner surface 37 of the first end 35A of the cap 35, and then, with the collar 25 against the outside wall 100 of the structure, slidingly positioning the cap 35 (with the housing 15 received in the first end 15A of the cap 35) along the water pipe 17 to the desired location so that the outer surface 16 of the outermost end 15A of the housing 15 is received within the central opening 29 of the collar 25 as previously described, thereby enclosing the housing 15. Thereafter, the outlet end 14B of the stem 14 is appropriately connected to the inner portion 41 of the sillcock 12 for a water-tight seal.

To repair a ruptured sillcock installed within the support sleeve 10, the user disconnects the sillcock 12 from the collar 25, and pulls the sillcock 12 from the wall 100. Pulling the sillcock 12 away from the wall 100 likewise pulls and exposes the stem 14 from the interior of the wall 100. The user then has access to the contents of the housing 15 namely, the sillcock 12 including the inner end 41 of the sillcock 12, and the stem 14. The user then threadably separates the inner portion 41 of the sillcock 12 from the outlet end 14B of the stem 14. The user is able therefore to separate the sillcock 12 from the stem 14 and repair or replace the ruptured sillcock and re-install as described above.

The frost proof sillcock service sleeve 10 prevents damage to a wall of a structure caused by a ruptured sillcock. It being understood that should the sillcock 12 rupture or crack, water leaking from the cracked sillcock 12 will remain within the inner chamber 15' of the housing 15 and drain through the collar 15, and outside the structure.

The frost proof sillcock service sleeve 10 of the present invention is relatively inexpensive to manufacture and is easy to install since it does not require any physical modification to the sillcock 12 or water pipe 17 when being installed. Furthermore, the service sleeve 10 may be adapted to varying lengths of sillcocks without jeopardizing the desired objectives of the present invention.

The preferred material for the housing 15, the collar 25, and the cap 35 is copper tubing and brass, however, said components may be formed of a variety of alternative materials.

Although the description above contains many specificities, these should not be construed as limiting the scope of the invention but as merely providing illustrations of some of the presently preferred embodiments of this invention. For example, while the collar 25 and the housing 15 are preferably attached by conventional means, such as sweat soldering, brazing, welding, or gluing, said components may be an initially integral part of a one piece body.

Thus the scope of the invention should be determined by the appended claims in the formal application and their legal equivalents, rather than by the examples given.

I claim:

1. A service sleeve coupled with a frost free sillcock for mounting within a wall of a structure, the sillcock including a body portion proximate the outside surface of the wall, and an inner portion proximate the inside surface of the wall, said service sleeve comprising:

an elongated cylindrical housing having an outermost end, an inner end, and an outer surface defining an inner chamber, a collar having a central opening, wherein the outermost end of the housing is received within the central opening of the collar, a cap having an inner surface, a first end, and a second end, wherein the first end of the cap having a diameter sized to receive the outer surface of the inner end of the housing, and the second end of the cap sized to slidingly receive the water pipe, a stem portion having a male portion and a female portion, said male and female portions having bores therethrough, said female portion having an inlet end that is coupled to the water pipe and an opening opposite the female portion's inlet end, said opening for access to the bore of the female portion, said male portion having an outlet end for connecting to the inner portion of the sillcock and an opening opposite the male portion's outlet end, said opening for access to the bore of the male portion, the male portion further including an extension portion, said extension portion having two circular grooves formed on the width of the extension portion to receive sealing rings, said extension portion configured to slide in and out the bore through the opening of the female portion, wherein the male portion and the female portion will generally be telescopically engaged, wherein the water pipe extends through the cap and in to the housing and coupled to the inlet end of the female portion of the stem within the housing, wherein water in the inner chamber of the housing is directed to drain through the collar and outside the structure.

2. The service sleeve as recited in claim 1, wherein the inner surface of the first end of the cap is in frictional contact with the outer surface of the inner end of the housing.

3. The service sleeve as recited in claim 1, wherein the inner surface of the second end of the cap is in frictional contact with the outer surface of the water pipe.

4. The service sleeve as recited in claim 1, wherein said collar extends radially from the outermost end of the housing and includes at least two screw holes to receive screws for securing the collar to the outside surface of the wall of the structure.

5. The service sleeve as recited in claim 1, wherein the inner portion of the sillcock, the stem, and the water pipe extending from the stem are axially aligned with the housing.

6. A method of installing a service sleeve coupled with a frost free sillcock within a wall of a structure, the sillcock including a body portion proximate the outside surface of the wall, and an inner portion proximate the inside surface of the wall, comprising the steps of:

positioning a collar having a central opening, and the body portion of the sillcock against the outside surface of the wall of the structure, determining the combined length of the inner portion of the sillcock, a stem portion, and a water line portion of the structure's water supply coupled to the stem portion, said stem portion including a female portion and a male portion configured for telescopic adjusting movement within the female portion, telescoping the male portion within the female portion to vary the length of the stem portion so that the combined length of the inner portion of the sillcock, the stem portion, and the water line portion approximately match the length of an elongated cylindrical housing, said housing including an outermost end, an inner end, and an outer surface defining an inner chamber, positioning a cap having an inner surface, a first end, and a second end, wherein the first end of the cap having a diameter sized to receive the outer surface of the inner end of the housing, and the second end of the cap sized to slidingly receive the water pipe, directing an end of the water pipe through the second end of the cap so that the first end of the cap confronts the outside wall of the structure, inserting the stem of the sillcock in the inner chamber of the housing, coupling the water pipe to the inlet end of the stem, inserting the outer surface of the inner end of the housing within the first end of the cap, slidingly positioning the cap along the water pipe until the outer surface of the outermost end of the housing is received within the central opening of the collar, securing the collar having at least two screw holes to receive screws to the outside of the wall of the structure, connecting the inner portion of the sillcock to the outlet end of the stem.

7. The method as recited in claim 6, wherein the inner surface of the first end of the cap is in frictional contact with the outer surface of the inner end of the housing.

8. The method as recited in claim 6, wherein the inner surface of the second end of the cap is in frictional contact with the outer surface of the water pipe.

9. The method as recited in claim 6, wherein the inner portion of the sillcock, the stem portion, and the water pipe extending from the stem portion are axially aligned with the housing.

10. A support sleeve coupled with a frost free sillcock having an inner portion, said support sleeve for mounting within a wall of a structure comprising:

an elongated cylindrical housing having an outer surface defining an inner chamber, a stem portion having a male portion and a female portion, said female portion having an inlet end that is coupled to a water pipe, said male portion having an outlet end for connecting to the inner portion of the sillcock, the male portion further including an extension portion, said extension portion having two circular grooves formed on the width of the extension portion to receive sealing rings, said extension portion of the male portion configured for sliding movement in and out the female portion, wherein the male portion and the female portion will generally be telescopically engaged, a cap having a bore therethrough, a collar having a central opening and at least two screw holes to receive screws for securing the collar to the outside of the wall of the structure, said central opening sized to receive the outer surface of the housing, wherein the water pipe extends through the cap and in to the housing and is coupled to the stem within the housing, wherein water in the inner chamber of the housing is directed to drain from the inner chamber, through the collar, and outside the structure.

11. The service sleeve as recited in claim 10, wherein the cap further includes an inner surface, a first end sized to receive the outer surface of the housing, said inner surface of the first end of the cap is in frictional contact with the outer surface of the housing.

12. The service sleeve as recited in claim 11, wherein the cap further includes a second end, said inner surface of the second end of the cap is in frictional contact with the outer surface of the water pipe.

13. The service sleeve as recited in claim 10, wherein the inner portion of the sillcock, the stem, and the water pipe extending from the stem are axially aligned with the housing.

* * * * *